US005765547A

United States Patent [19]

La Plante

[11] Patent Number: 5,765,547

[45] Date of Patent: Jun. 16, 1998

[54] HEATER FIRE PREVENTION DEVICE, SYSTEM AND METHOD

[76] Inventor: Thomas E. La Plante, 1442 Gower Rd., Scotia, N.Y. 12302

[21] Appl. No.: 746,651

[22] Filed: Nov. 13, 1996

[51] Int. Cl.[6] ..... F24H 1/00

[52] U.S. Cl. ..... 126/361; 122/13.1; 122/14; 122/11

[58] Field of Search ..... 126/361, 350 R, 126/85 B; 122/13.1, 16, 17, 18, 19, 14

[56] References Cited

U.S. PATENT DOCUMENTS

| | | | |
|---|---|---|---|
| 3,091,223 | 5/1963 | Vitale | 126/85 B |
| 3,707,142 | 12/1972 | Kobayashi | 126/85 B |
| 4,974,551 | 12/1990 | Nelson | 122/494 |
| 5,020,481 | 6/1991 | Nelson | 122/494 |
| 5,020,512 | 6/1991 | Vago et al. | 126/350 R |
| 5,085,205 | 2/1992 | Hall et al. | 126/350 R |
| 5,533,495 | 7/1996 | Moore | 126/361 |

*Primary Examiner*—Carroll B. Dority
*Attorney, Agent, or Firm*—Jay R. Yablon

[57] ABSTRACT

Disclosed herein is a fire safety and prevention method, system and apparatus for preventing flammable fumes or vapors from entering into the pilot light or flame area of a gas hot water or other type of heater and igniting into a fire, which is easily installed at low cost and without special expertise.

The preferred embodiment is a simple metallic or similar cylinder placed around the heater, with appropriate vapor-tight seals, which will prevent flammable vapors moving near the floor from entering the heating area and igniting.

Also disclosed is a method, system, apparatus and method to incorporate this safety feature into the manufacture of new gas hot water and other heaters.

6 Claims, 6 Drawing Sheets

FIG. 1 *(Prior art)*

HEATER FIRE PREVENTION DEVICE, SYSTEM AND METHOD

FIELD OF THE INVENTION

This invention pertains to fire safety and prevention devices generally, and specifically, discloses a system, apparatus and method for preventing the flammable vapors from entering the pilot light and flame area of a heater and igniting into a fire.

BACKGROUND OF THE INVENTION

A wide range of heaters provide the convenience of hot water and heat to very many homes and office facilities throughout the United States and the rest of the world. However, these heaters have also been known to ignite deadly fires when gasoline or other flammable materials spill or are located too close to the heater. In particular, the pilot light and the heating flame which burn within these heaters are typically located within three to six inches of the floor, and, more importantly, air used for combustion is also drawn from within a few inches of the floor. Flammable vapors (fumes) from gasoline and other combustibles, which fumes are heavier than air, also travel very close to the floor. So when a flammable material is spilled near the heater, or is located too close to the heater flame, the vapors travel within a few inches of the floor, enter the heater from an area near the heater flame which is also close to the floor, and ignite, causing a situation with potentially deadly consequences.

A common approach to remedy this situation, particularly used for gas hot water heaters, is to raise the heater to a height of perhaps 18 to 20 inches above the floor, to a position where the flame, and the location where air enters the heater for combustion, are similarly elevated. Many heating contractors and supply stores provide platforms to raise a heater for precisely this purpose. By moving the flame and air entry 18 to 20 inches above the floor, the fire danger is diminished, since the fumes emanating from the flammable material in question would themselves need this 18 to 20 inches above the floor in order to ignite. Because these fumes tend to travel within a few inches of the floor, the fire danger is diminished by this raising of the flame, and more importantly, of the air entry points.

However, the process of raising a heater off of the floor is time consuming and expensive. The owner of the heater, unless he or she has special expertise, will need to hire a heating contractor or plumber who must disconnect the water, gas, ventilation and other connections to the heater, raise the heater, reconfigure water, gas and ventilation (e.g., lengthening or shortening pipes, reconfiguring the chimney, etc.), and then reattach all of these connections. Further, while it would be desirable to raise the air entry even higher, this is often limited by ceiling height. And, since most heaters are located in basement areas of diminished ceiling height, in many cases the space containing the heater does not have sufficient overhead room to raise the heater even 18 to 20 inches in this manner, or to provide proper chimney ventilation, and so this approach is simply not possible. In all cases, this approach is certainly very costly.

Finally, for heaters other than gas hot water heaters, this method is even more costly, and in many instances is simply not viable.

OBJECTS OF THE INVENTION

It is an object of this invention, therefore, to provide a device and method which prevents flammable vapors from reaching the pilot light or flame of a heater and then igniting, without the need to raise or in any other way move, reconfigure, or modify the heater or its various connections.

It is a further object of this invention for said device and method to be simple enough so that an ordinary homeowner or custodian of a public or commercial facility can install the device and utilize this method with a minimum of time or specialized expertise.

It is a further object of this invention for said device and method to be of low cost, and of substantially lower cost than the disconnection, raising, reconfiguration and reconnection of a heater as described above.

It is a further object of this invention to provide said device and method such that it can easily be retrofitted with and utilized in conjunction with an existing, installed heater, to avoid the necessity for purchase of a new heater and replacement of a properly functioning existing heater.

It is a further object of this invention to overcome the 18 to 20 inch limit imposed in situations where the heater is itself raised in its entirety, so that the air entry level can be raised above the floor to a height of two to three feet, or more, as desired.

It is a further object of this invention to provide a safety feature device and method which prevents flammable vapors from reaching the pilot light or flame of a heater and which can be integrated directly into the design and manufacture of such heaters in the future, so that such heaters can be installed at the outset with this safety feature, and, unlike an existing, installed heater, need not be retrofitted with this feature.

It is a further object of this invention to provide this safety feature, universally, for any and all heaters that take in air for combustion from relatively close to the floor, and that therefore present the danger of flammable elements mixing with the intake air and igniting by coming into contact with a flame inside the heater.

SUMMARY OF THE INVENTION

The invention disclosed herein takes advantage of the fact that flammable vapors are heavier than air, and travel within a few inches of the floor when spilled on that floor, by forcing air used for heating combustion, and hence any flammable vapors that may be in the vicinity of the heater, to enter the heater from a height of at least two to three feet off the floor. Thus, this invention creates a Fireguard™ vapor barrier or shield around the pilot light and flame of a heater such that, in order to ignite, a flammable vapor outside that shield would need to travel at least two to three feet from the floor, enter the shield at that height with the intake air, and then travel back down within the shield to the pilot light or flame of the heater to ignite. In this way, a significant fire danger is effectively eliminated.

In the preferred embodiment of the invention, involving the retrofitting of this device and method to and with already-installed heaters, this vapor shield can be installed around the circumference of an existing heater, requiring no modifications whatsoever to the heater itself, in a simple manner enabling rapid, low-cost installation by a person lacking any special plumbing or heating skill.

In this embodiment, the vapor shield is essentially a vapor-impermeable cylinder of perhaps two to three feet in height that is placed around the circumference of the heater. A seal attached to the bottom of this cylinder, where the cylinder rests on the floor, prevents flammable vapors from travelling just above the floor and reaching the pilot light or flame such that they might ignite. If the vapors were to reach the pilot light or flame, they would have to travel upwards two to three feet above the top of the shield, and then back down another two to three feet within the shield, in order to ignite. As such, this effectively prevents flammable vapors from penetrating to reach the pilot light or flame of the heater, and thereby prevents a significant fire hazard.

A simple method for lifting and holding the cylinder off the floor, to achieve maintenance access to the heater, is also disclosed.

In an alternative embodiment, a shield of this type can be manufactured integrally with new heaters, such that flammable vapors will still have to rise at least two feet off the floor in order to come in contact with the pilot light or flame of the heater, and will thus make these heaters substantially safer by eliminating the very serious fire danger presently associated with these heaters.

For a newly-manufactured heater, the shield need not be the cylinder used for retrofitting, but need simply be a shield affixed to the area where air presently enters the heater to enable burning of the pilot light or flame, with appropriate air channels, such that this shield and associated channels do not allow entry of air from a height below two to three feet. Similarly to the preferred (retrofitted) embodiment, access to the heater is provided for maintenance purposes.

While two embodiments are disclosed herein, one for retrofitting to old heaters and one for use in the manufacture of new heaters, the main thrust of this invention is to force intake air used for combustion, and hence and flammable vapors that may mix with this air, to enter the heating unit from a height of at least two to three feet above the floor, in contrast to the three-to-six inch height that is customary in existing heaters, without raising or in any way modifying the position of the heater. Thus, any variation on the embodiments disclosed, wherein such variation in net effect forces intake air to be drawn from higher than is customary in conventional heaters (e.g. from two to three feet, or more off the floor), using any means that may be obvious to someone of ordinary skill, is regarded to be within the scope of this disclosure and its accompanying claims.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE PREFERRED EMBODIMENT OF THE INVENTION

Figure 1:
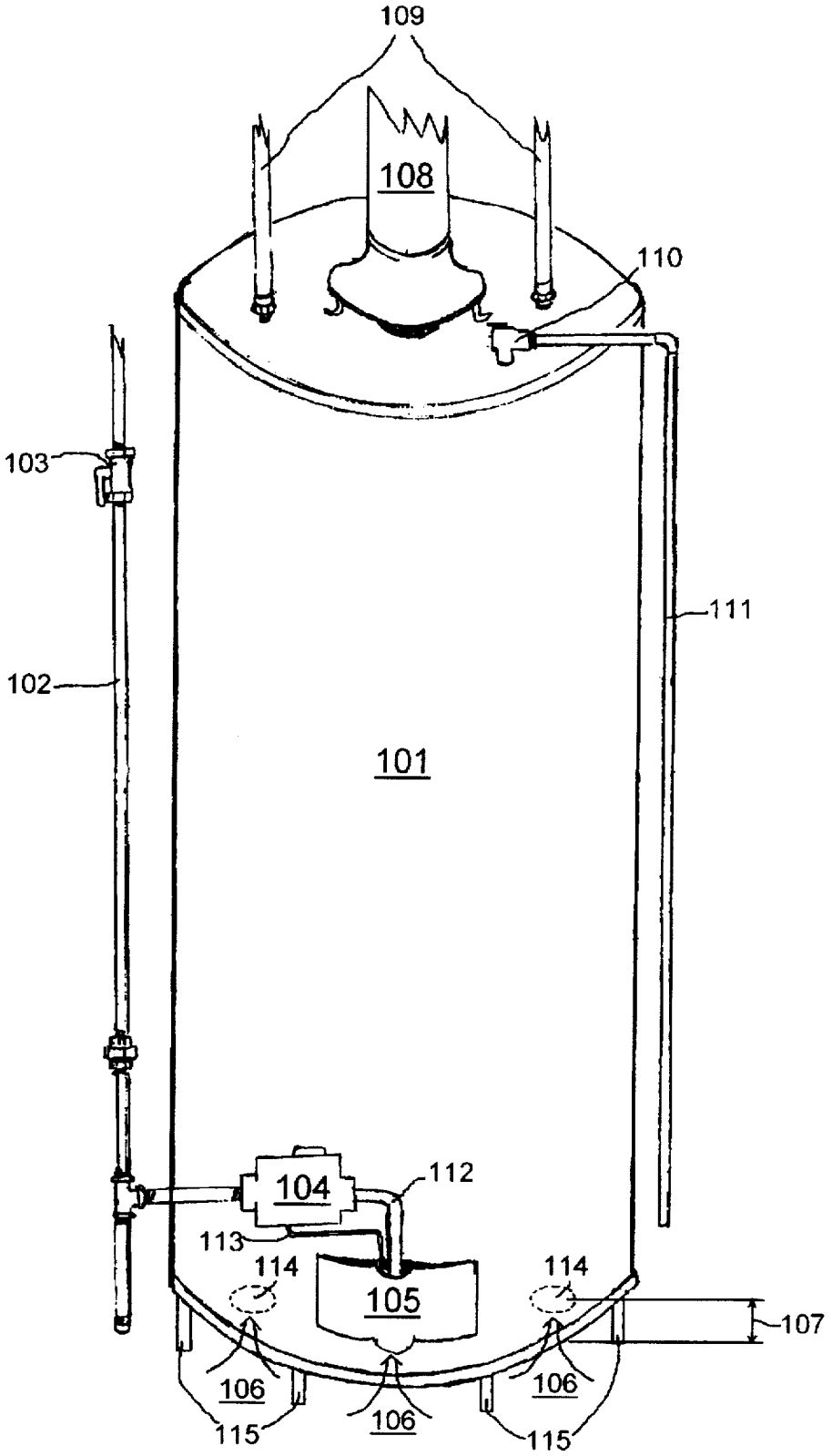
FIG. 1 depicts the prior art, namely, a standard gas hot water heater that is unprotected from entry of flammable vapors into the pilot light or flame area. While a gas hot water heater is used as an example, the invention disclosed herein is universally applicable to other heaters as well.

FIG. 1 depicts the prior art, namely, a standard gas hot water heater that is unprotected from entry of flammable vapors into the pilot light or flame area. While a gas hot water heater will be used as an example throughout, this principles and embodiments of this invention can be universally applied to any heating system that draws air from close to the floor, into the heating system, for combustion heating.

In FIG. 1, a gas hot water heater 101 receives gas through a gas supply line 102 and a gas cock 103, that feed the gas past a gas control valve 104, through a final gas supply line 112, and to the base of the heater, behind a servicing door 105. Also depicted is a thermal couple and/or pilot light gas feed 113. Air, which supplies the oxygen necessary to permit burning of the gas, then enters from beneath the door 105, and through one or more air entry apertures 114 in the bottom (underside) of the heater, as depicted by directional arrows 106. The heater is typically raised above the floor by a height of perhaps three to six inches, by a set of legs or footings 115 of a similar three to six inch height. The distance 107 above the floor at which the air enters, therefore, is typically no more than three to six inches. Ventilation of the combustion byproducts takes place through a chimney 108, cold water is fed into and hot water extracted from the heater by water lines 109, and pressure from the heater is relieved by a pressure relief valve 110 and pressure relief pipe 111.

In this typical heater configuration, the fumes from a flammable liquid spilled or located near the heater will waft toward the heater and, since they are heavier than air, will be concentrated in the three to six inch space directly adjacent to the floor. As such, they will mix with the air and enter the heater with the air along the directional arrows 106 through the apertures 114 and the door 105, from close to the floor, and will ignite when they come into contact with the pilot light or flame. The fire from this ignition will then propagate rapidly back to the flammable liquid source, causing the liquid to ignite into a potentially deadly and certainly destructive fire.

Figure 2:
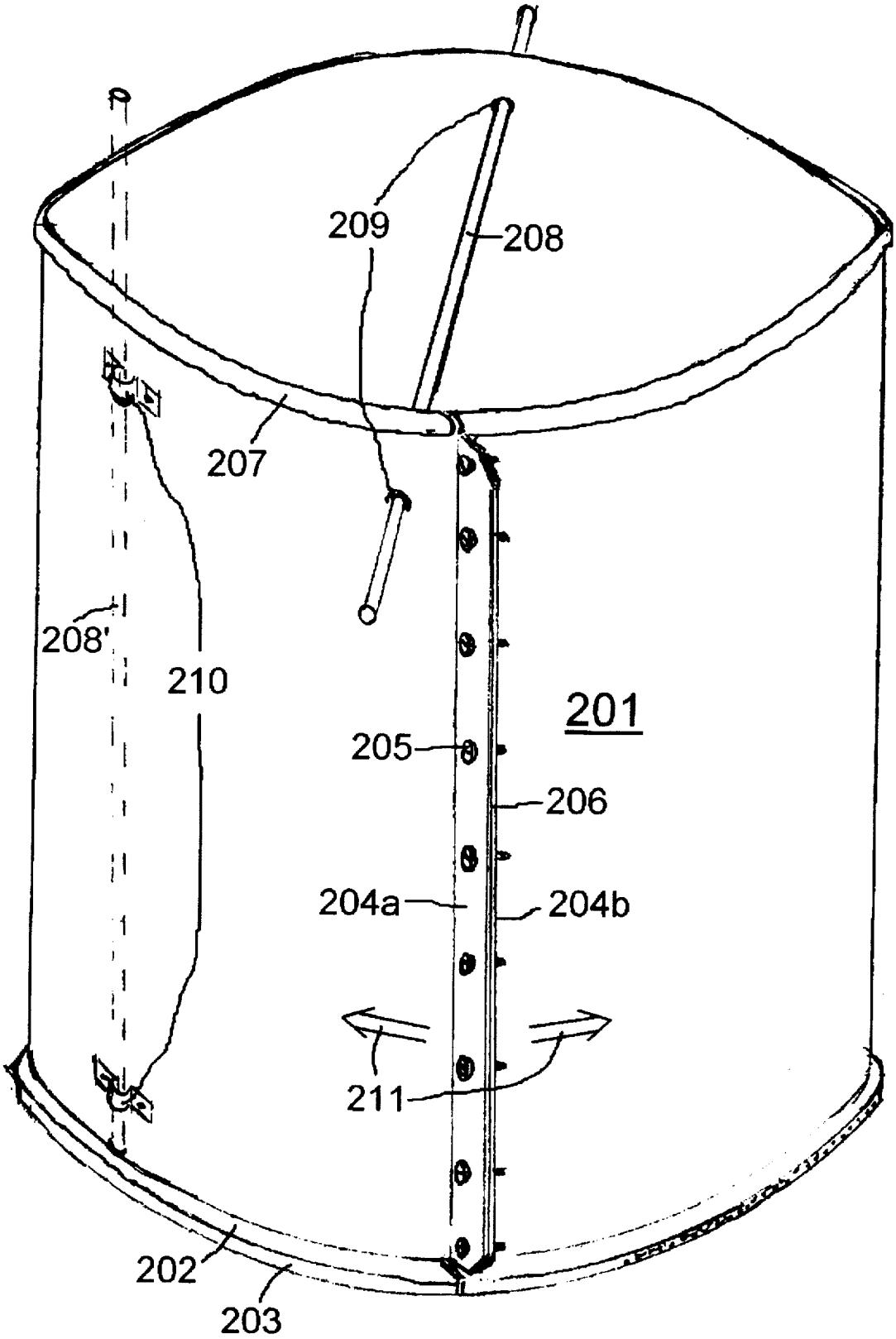
FIG. 2 depicts a vapor barrier or shield that may be retrofitted to existing, installed heaters, and further depicts the various components of said shield.

FIG. 2 depicts a vapor barrier or shield that may be retrofitted to existing, installed, heaters, and the various components of said shield, to avert this problem.

The vapor barrier or shield 201 is essentially a cylinder (or drum) as shown, which is open at the top and bottom, and which is placed around the circumference of the heater in a manner to be later described in connection with FIG. 3. The bottom of the shield 201 preferably contains a flange 202, and a first vapor-tight seal 203 attached to the base of the shield 201 along the underside of the flange 202. Many different substances well-known in the art can be used for purposes of this seal 203 by properly excluding flammable vapors, including, but not limited to, any type of soft foam rubber or weather stripping type material such as bulb-type weather stripping. A self-stick feature, i.e. wherein the seal 203 ability to adhere to the underside of the flange 202, is also desirable. Note, while attachment of the seal 203 to the underside of the flange 202 is desirable for ease of installation, this disclosure also encompasses placing an appropriate seal 203 on the floor, and then placing the shield 201 atop this seal 203, with the flange 202 seated in direct contact with and above the seal 203.

The cylinder of the shield 201 has two end sections **204*a* and 204*b*. To install (i.e., retrofit) the shield 201 around an already-installed heater, the end sections 204***a* and 204*b* are separated from one another in the manner indicated by directional arrows 211 and the shield 201 is thereby configured into an open position. The shield 201 in this open position is then brought around the heater (as will be seen in FIG. 3), the end sections 204*a* and 204*b* are then brought back together into the closed state depicted by FIG. 2 with the heater enclosed by the shield, and the end sections 204*a* and 204*b* are then secured to one another via attachment means 205, with a second vapor-tight seal 206 between the two end sections 204*a* and 204*b*.

The attachment means 205 which may be a series of simple screws, or a series of latches, or any other hardware device that would be obvious to someone of ordinary skill for the purpose of securely connecting the two end sections 204*a* and 204*b*. The seal 206 can similarly be achieved using a wide variety of materials well-known in the art for these purposes, including, but not limited to various foam rubber and weather strip compounds. A self-stick adhesion, wherein these compounds can be secured directly to an end section 204*a* or 204*b*, is again desirable to facilitate ease of installation. Preferably, the shield 201 also has a rolled edge 207 on top, to add lateral strength, to soften the edge so that a person handling the shield will not be cut, and to enable easy lifting for maintenance as will be discussed below in connection with FIG. 4. Similarly, while the shield 201 shown here has a cylindrical shape, any other workable shape is also contemplated by this disclosure and covered by the associated claims. And while this figure depicts two end sections 204*a* and 204*b* making a single connection (one joint), there are obviously many variations of this approach which will readily allow installation, and which may be more appropriate for the size and shape of heaters other than gas hot water heaters, all of which are contemplated by this disclosure and covered by the associated claims.

The substance comprising the vapor shield 201 cylinder is of sufficient flexibility that it can be opened wide enough (in the direction depicted by arrows 211) to be placed around the heater for installation, and then closed fully such that the two end sections 204*a* and 204*b* may be brought into direct contact with and secured directly to one another via the attachment means 205, and with the second vapor-tight seal 206. This substance must also have sufficient rigidity to maintain the shield 201 in a fixed, upright position around the heater. And, it must also be impermeable to flammable vapors. Aluminum, tin, and other impermeable yet semi-flexible, semi-rigid materials, are appropriate for use as the underlying material comprising of this cylinder. So too would be any plastic, rubber, or other natural or synthetic compound which has the desired characteristics of vapor impermeability, semi-flexibility, and semi-rigidity. For more rigid materials, (or for application to a larger, or other type of heating system) a two-joint system (e.g. four edge) system, or some other obvious variations, could also be employed. To enable easy lifting of the shield 201 for heater maintenance (as will be discussed in connection with FIG. 4), it is also helpful if the substance comprising the shield 201 is of reasonably light weight.

Figure 4:
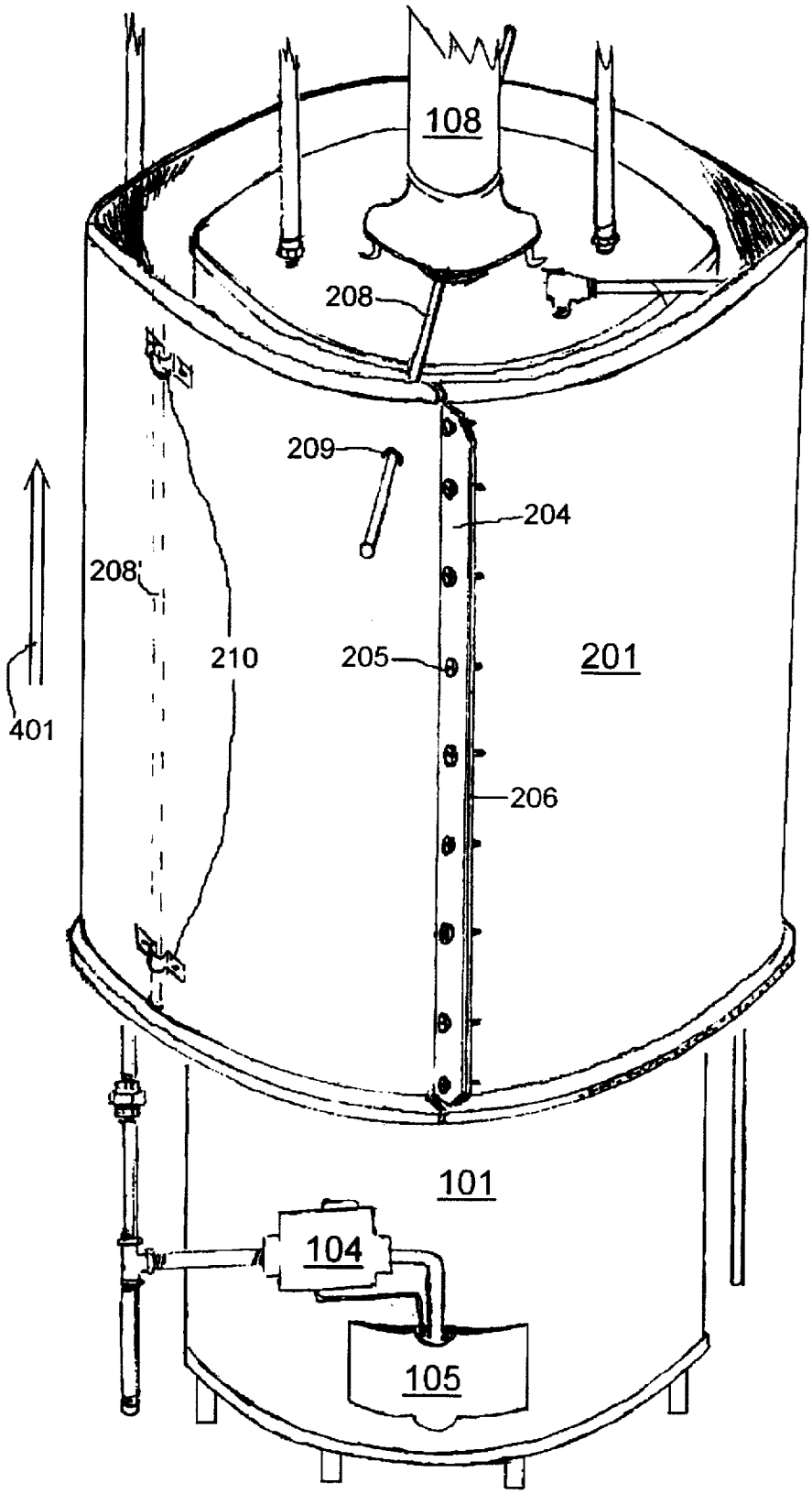
FIG. 4 depicts one method of gaining access to the heater, past the vapor barrier or shield, for maintenance purposes, without the need for deinstalling said shield.

Also shown in FIG. 2 is a service rod 208 which, when in use in the manner to be later discussed in connection with FIG. 4, is placed through service rod receptacles 209. When not in use, the rod is placed (stored) in the position depicted by 208', and secured to the side of the shield 201 with service rod storage clamps 210.

Figure 3:
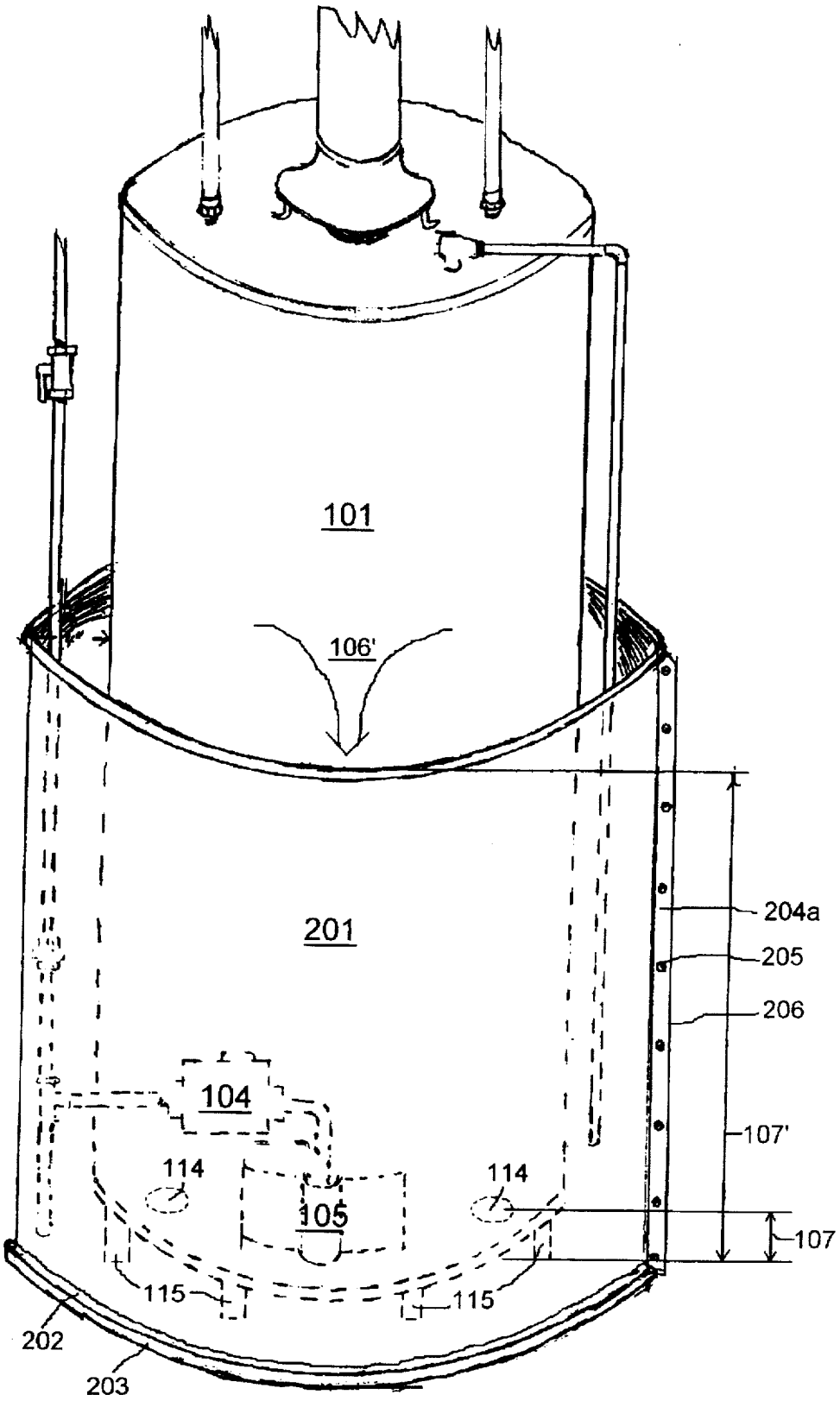
FIG. 3 depicts the method by which the vapor barrier or shield of FIG. 2 may be retrofitted to, and used in connection with, a standard hot water heater such as depicted in FIG. 1.

FIG. 3 now depicts the method by which the vapor barrier or shield of FIG. 2 may be retrofitted to, and used in connection with, a standard, gas hot water heater such as depicted in FIG. 1. Again, while a gas hot water heater is used as an example, this is applicable to any heater that takes in air for combustion from close to the floor, and the disclosure and associated claims encompass the use of this invention in connection with any and all such heaters.

In this figure, the heater 101 is surrounded by the vapor shield 201, which shield has been installed about the heater in the manner discussed in connection with FIG. 2. The portions of the heater 101 enclosed by the shield 201 are depicted by broken lines. For reference, also shown are the gas control valve 104 and the service door 105 of the heater 101, as well as the flange 202, first vapor-tight seal 203, one end 204*a*, attachment means 205, and second vapor-tight seal 206 of the shield 201.

When the vapor shield 201 is placed about the heater 101 in this manner, with all seals as indicated, the air containing oxygen used for proper heater combustion is forced to enter the heater from above the shield, as indicated by the directional arrows 106'. The shield and seals bar this air from entering from below. Thus, the air will now be taken from a distance 107' above the floor that is fixed by the height of the shield 201, and said height is optimally designed to be at least two, and perhaps as much as three or more feet. This is in contrast to the air entry earlier depicted at perhaps three to six inches, as shown by 106 and 107 in FIG. 1. Air used for combustion will thus travel downward from its entry 106', and into the apertures 114 and under the door 105, for combustion.

In the configuration of FIG. 3, any flammable vapors located or spilled near the heater would have to travel up the entire height 107', enter with the air as indicated by directional arrows 106', travel back down to the original height 107, and then get into the apertures 114 or under the door 105 to ignite. As these vapors, again, are heavier than air, they will remain concentrated a few inches above the floor, will not rise high enough to get past the shield 201, and thus will not ignite. In this manner, this invention prevents a very significant fire hazard typically associated with a wide variety of heaters.

Further, this is achieved without the need to disconnect, move, reconfigure and reconnect the heater. Whereas the only fire preventive measure know to date is to raise the heater to 18 to 20 inches above the floor so as to force the vapors to rise by this height before they ignite, this invention achieves a superior result, confronting the vapors with a two-to-three foot rise (and indeed, a rise adjustable to any height desired, as redetermined from the manufactured height of the shield 201), but without any need to raise or reconfigure the heater. The installation is as simple as opening the shield 201 at its end sections 204*a* and 204*b*, placing it around the heater 101, closing and attaching (205) these end sections with the second vapor-tight seal 206 in between, and placing the entire shield 201 on the floor about the heater, with the first vapor-tight seal 203 beneath the shield 201. This can be done in a few minutes by a homeowner or custodian without any expertise in heating or plumbing, and at a cost many times reduced from the cost of having to disconnect, raise, reconfigure and reconnect an entire heater.

FIG. 4 depicts a simple way to gain access to the heater for routine maintenance purposes. The service rod 208 is first removed from its position 208' on the service rod storage clamps 210. Then, the entire vapor shield 201 is lifted up from the floor as indicated by the arrow 401. The receptacles 209 are raised to a level just above the top surface of the heater 101, and the rod 208 is placed through the receptacles 209 such that it then rests across the top surface of the heater 101 as shown, and will therefore hold the shield 201 in a elevated position while maintenance work is performed on the lower section of the heater 101. When maintenance is completed, the rod 208 is removed from receptacles 209 and restored to the clamps 210, and the shield 201 is lowered back to its original position on the floor, with the seal 203 below the shield 201 as shown in FIG. 3.

While this is one embodiment of a method, system and apparatus for gaining access to the heater for routine maintenance, it is apparent that someone of ordinary skill may conceive of other obvious variations to achieve the primary net result of this invention, which is to force the heater to accept intake air from at least two to three feet above the floor, and to bar entry of air or flammable vapors from below this height, in a manner that averts fire hazard from these vapors. Any such variations are contemplated to be within the scope of this disclosure and its associated claims.

Figure 5:
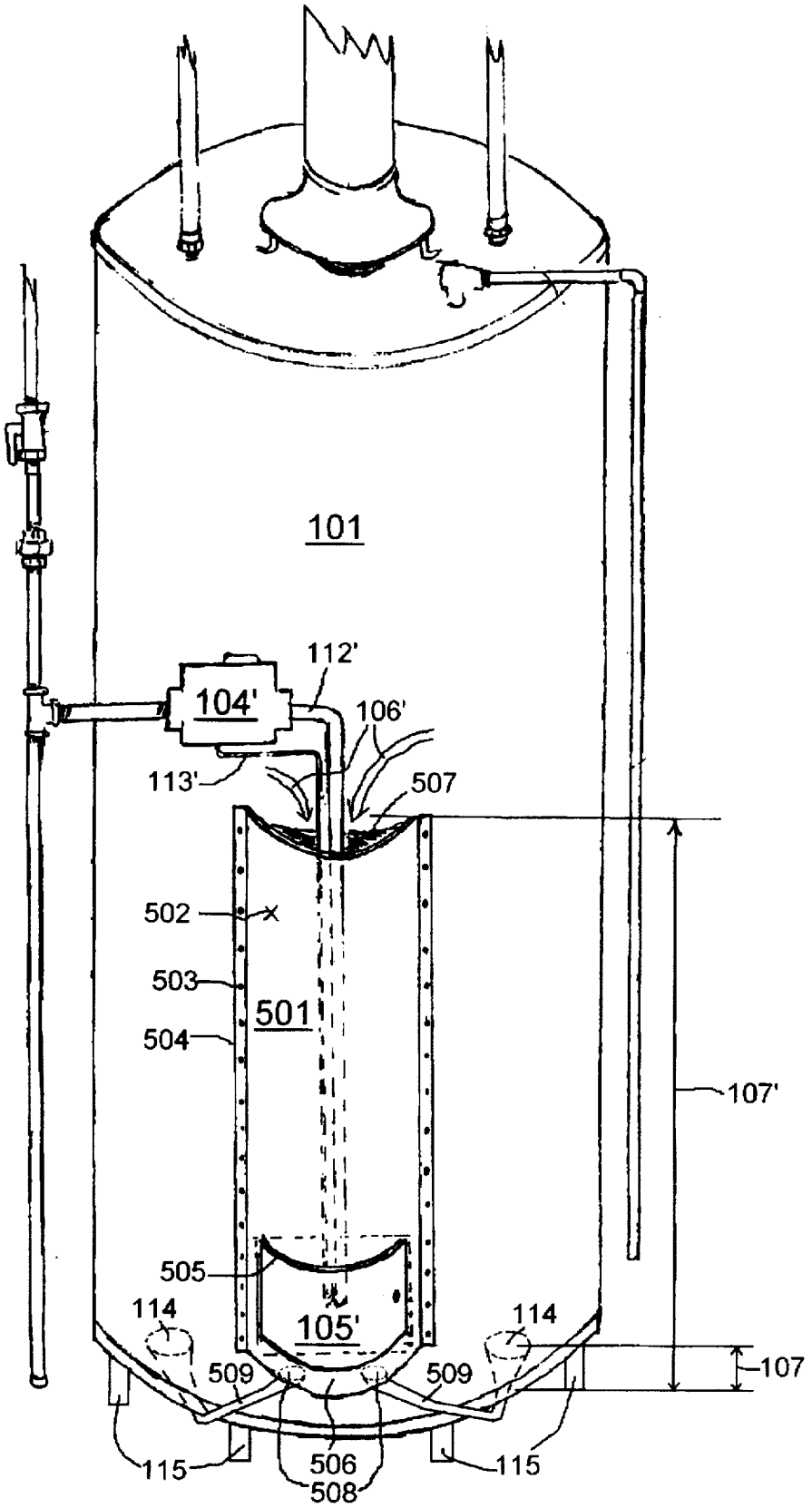
FIGS. 5 and 6 depict alternative embodiments of this invention, wherein the vapor barrier or shield is incorporated directly into the manufacture of a heater, for future utilization in and with the manufacture of new heaters.

FIG. 5 depicts an alternative embodiment of this invention, wherein the vapor barrier or shield is incorporated directly into the manufacture of a hot water heater, for future utilization in and with the manufacture of new hot water heaters. Again, the device and approach depicted here can be applied equally to other types of heater as well.

In this embodiment, the heating unit 101 remains essentially unchanged. However, an integrally manufactured vapor barrier or shield 501 is attached directly to the front of the heater as shown. The gas control valve 104 is now placed in a higher position, 104', above the integrally manufactured shield 501. Similarly, the gas supply line 112 and thermal couple and / or pilot light gas feed 113 are extended as now depicted by 112' and 113'. The pilot light and flame are still at the bottom of the heater, perhaps three to six inches above the floor.

This integrally manufactured vapor shield 501 provides an air column 502 between it and the heater 101, with air entering for combustion through an air entry opening 507 at the upper extremity of the shield 501. It is attached to the heater by attachment means 503 which can comprise screws, bolts, welding, or any other means commonly known in the art to achieve this purpose, with a vapor tight seal 504 at the point of contact between the shield 501 and the heater 101, which again, can comprise any suitable substance known in the art to block the entry of flammable vapors. The service door 105 is replaced by a hinged service door 105' that, when closed, rests against the front face of the shield 501 as shown, with a vapor-tight service door seal 505 between the door 105' and the shield 501. This seal 505, too, can use any material known in the art appropriate for sealing off flammable vapors. This service door 105', when opened, allows maintenance access to the heater. The opening of this door to permit servicing thus achieves the same result as using the service rod 208 to hold shield 201 in a lifted position as shown in FIG. 4, in the retrofitted embodiment of this invention. While a hinged door 105' is the preferred embodiment, this disclosure also contemplates and encompasses obvious variations for the attachment of this door to the shield 501, so long as the vapor seal 505 can be maintained.

Finally, the bottom face 506 of shield 501 is solid and airtight, and preferably manufactured as a unitary part of the shield 501. In the variation shown, this bottom face 506 comprises air channel apertures 508. One then runs airtight air channels 509 from these apertures 508 to the air entry apertures 114. While these channels 509 are depicted in this particular embodiment attached to the bottom face 506 and running along the outside face of the heater and then under the bottom face of the heater, any configuration will suffice, and is within the scope of this disclosure and associated claims, so long as it ensures that air entering the apertures 114 and behind the service door 105 or 105' is drawn from well above three-to-six inches above the floor, i.e., from the distance 107', rather than the distance 107.

Thus, when the shield 501 is secured in place and the door 105' is closed with the seal 505 intact, air, as well as flammable vapors, are unable to enter the pilot light and flame area behind door 105' from below. Thus, all air enters in the manner depicted by 106', at the height indicated by 107' through the opening 507, which, again, is at least two to three feet above the floor. Air entering the air entry apertures 114 via the air channels 509 and from behind the service door 105', is drawn from well above the floor. Thus, similarly to the retrofitted embodiment, air and vapors are prevented from entering at the height 107 of perhaps three to six inches above the floor, from which they can otherwise enter a heater that is unprotected by this invention. Again, this stops the possibility of these vapors igniting from the heater, and averts a significant fire hazard.

Thus, the same end result is achieved by the disclosure of FIG. 5 as was achieved in FIG. 3, namely, air and any flammable vapors that may mix with that air, is forced to enter from a height of at least two to three feet above the floor, and is barred from entering below that height, which serves to prevent a significant fire hazard without requiring the heater to be raised two or three feet above the floor. FIG. 3, however, is a retrofit device and method for existing heaters, which avoids their premature removal and replacement. FIG. 5 shows an improved heater design for future manufacture, so that avoidance of this fire hazard is built in from the start.

Figure 6:
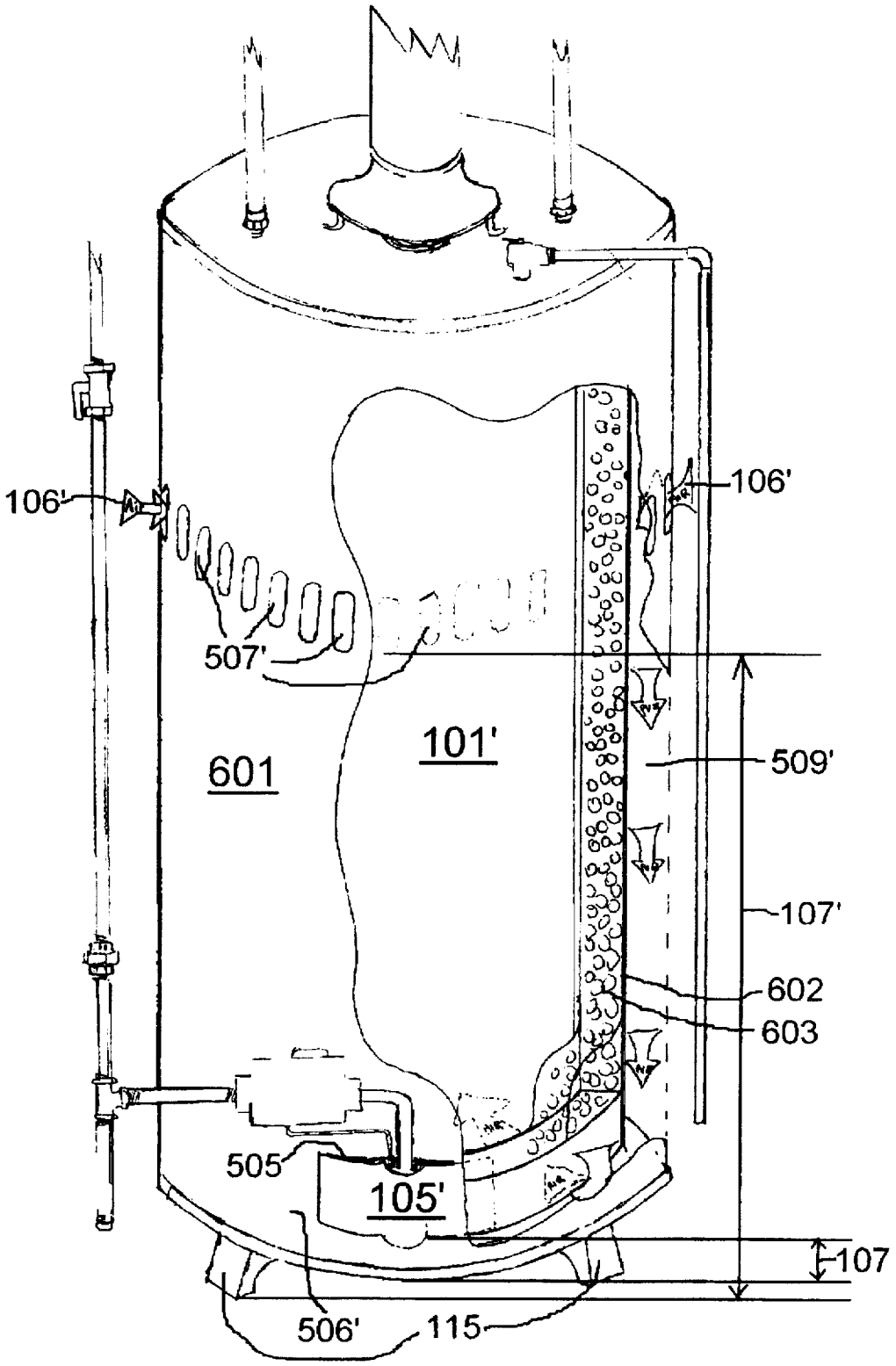

FIG. 6 shows yet a further embodiment wherein a heater can be manufactured from the outset, such that it is forced to draw air from several feet above the ground, thereby barring entry of air or flammable vapors from near the ground.

In FIG. 6, the heater of FIG. 1, 101, is now 101', since it now forms an inner jacket 602 residing fully within a vapor shield that is now embodied as an outer jacket 601. Part of the outer jacket 601 and inner jacket 602 are shown cut away on the right side of FIG. 6, exposing, e.g., insulation 603 on the inner jacket that is ordinarily part of a heater 101 or 101', but which it has not been necessary to expressly show in the prior figures. FIG. 6 shows all the critical features shown in FIG. 5, but configured in a different embodiment for achieving the same engineering result of barring any air (and hence flammable vapors) from entering the heater below an elevated height 107' of at least two to three feet above the floor.

FIG. 6 illustrates an air entry opening 507', which serves a purpose identical to that of the opening 507 earlier illustrated in FIG. 5, comprising in this embodiment, a plurality of openings as shown. These openings permit air to enter along the directional arrows 106', at the elevated height denoted by 107'. The inner jacket 602 is elevated above the bottom face 506' of the outer jacket by the usual height 107 of perhaps three to six inches, while the outer jacket may itself be propped up on a series of legs 115.

What is particularly important, is that the vapor shield now embodied as the outer jacket 601 is fully airtight at all heights below 107'. Thus, the bottom face 506 of the outer jacket 601 is airtight, and when the maintenance door 105' is closed, this door once again makes an airtight seal 505 with the shield, in this embodiment, the outer jacket 601. With this seal intact, air utilized for combustion is forced to enter through the openings 507' as shown by arrows 106', and travels downward through an air channel 509' that, in the variation of FIG. 6, is embodied by the depicted airgap space 509' between the outer jacket 601 and inner jacket 602 (i.e., the heater 101'), with further arrows depicting this downward flow of this air. (In FIG. 5, this air channel was embodied in 502 and 509.) At the bottom of the inner jacket, this air then enters the heater 101' (i.e., the inner jacket 602) or combustion from below, in the same way that it ordinarily enters a heater 101, e.g., via air entry apertures 114 as shown in FIG. 1, not expressly shown here. Because the air for combustion is again drawn from the height 107', as with FIG. 5, and as with the earlier depicted retrofitted embodiment of FIG. 3, flammable vapors near the ground cannot enter the heater to ignite into a fire.

While FIGS. 5 and 6 shows two embodiments for achieving the desired result of keeping flammable vapors away from the combustion area of the heater, it is again understood that the primary engineering goal of this invention is to force air to enter the heater combustion area from a height well above the floor (at least two to three feet and certainly more than the customary three to six inches), and thereby bar any flammable vapors travelling closer to the floor from entering with the air and igniting into a fire. Thus, the manifold of heater designs which may be conceived to achieve this fundamental engineering goal of forcing an air draw from an elevated height, and barring an air draw from a lower height, is contemplated by this disclosure and its associated claims.

Further, although a gas hot water heater has been used as the preferred embodiment in this disclosure, this device and method can be used with any heater of any nature, that draws air for combustion from close to the floor, and for which the drawing of air from a higher elevation would prevent fire hazard from combustible materials residing in the floor area. It is envisioned that this disclosure and associated claims will apply to all such heaters.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A fire prevention system for use in connection with a heater, said heater already installed with preexisting connections and being in a preexisting position, comprising:

a vapor shield separate from said heater, comprising end sections and means for attaching said end sections to one another, wherein:

said vapor shield is retrofitted to encircle a lower portion of said heater without disturbing said preexisting connections and said preexisting position of said heater, by placing said vapor shield about said heater while said end sections are in a state of detachment from one another and then attaching said end sections to one another; wherein said vapor shield includes a flexible seat at an end adjacent a floor supporting said shield and extends from said floor to a distance of at least 6" above said floor and spaced from said heater to force intake air to be drawn from more than six inches above a floor supporting said vapor shield to an air intake opening in a lower portion of said heater, and thereby blocks flammable vapors away from said heater and preventing them from entering a combustion area of said heater and igniting.

2. The system of claim 1, further comprising a vapor seal maintained between said end sections.

3. The system of claim 1, further comprising a service rod and service rod receptacles, wherein the lower portion of said heater is accessed for service by lifting the vapor shield upwards, and placing said service rod through said service rod receptacles such that the service rod rests against the top face of the heater, and, via its contact with said receptacles, thereby maintains the vapor shield in the upwardly-lifted position.

4. A method of preventing fire, for use in connection with a heater having an air intake opening adjacent its lower end, comprising the step of:

barring intake air from entering said heater from less than six inches above a floor supporting said heater by retrofitting a vapor shield separate from said heater to encircle a lower portion of said heater without disturbing preexisting connections and a preexisting position of said heater by providing said vapor shield with end sections with means attaching said end sections to one another, and a flexible seal on an end of said vapor shield adjacent said floor.

5. The method of claim 4, further comprising maintaining a vapor seal between said end sections so-attached.

6. The method of claim 4, wherein the lower portion of said heater is accessed for service by lifting the vapor shield upwards, and placing a service rod through service rod receptacles such that the service rod rests against the top face of the heater, and, via its contact with said receptacles, thereby maintains the vapor shield in the upwardly-lifted position.

* * * * *